US007172513B1

(12) United States Patent
Rinker

(10) Patent No.: US 7,172,513 B1
(45) Date of Patent: Feb. 6, 2007

(54) TOOL FOR DETERMINING OPTIMAL PUTTER CHARACTERISTICS

(76) Inventor: James Rinker, 5534 Oak Ridge Ave., New Port Richey, FL (US) 34652

( * ) Notice: Subject to any disclaimer, the term of this patent is extended or adjusted under 35 U.S.C. 154(b) by 169 days.

(21) Appl. No.: 11/082,635

(22) Filed: Mar. 17, 2005

(51) Int. Cl.

| | |
|---|---|
| ***A63B 69/36*** | (2006.01) |
| ***A63B 53/04*** | (2006.01) |
| ***A63B 53/06*** | (2006.01) |
| ***A63B 53/16*** | (2006.01) |
| ***G01B 1/00*** | (2006.01) |

(52) U.S. Cl. ..... 473/219; 473/238; 473/239; 473/242; 473/251; 473/296; 473/334; 473/339; 473/340; 33/508

(58) Field of Classification Search ..... 473/340–341, 473/219, 242–248, 251, 334–339, 288, 296, 473/239, 282, 407; 73/65.03; 33/508
See application file for complete search history.

(56) References Cited

U.S. PATENT DOCUMENTS

| | | | | |
|---|---|---|---|---|
| 1,331,499 | A * | 2/1920 | Vassallo | 473/243 |
| 1,697,846 | A * | 1/1929 | Anderson | 473/246 |
| 2,179,034 | A * | 11/1939 | Duncan, Jr. | 473/247 |
| 3,822,477 | A * | 7/1974 | Collins | 33/508 |
| 4,104,802 | A * | 8/1978 | Johnston | 33/508 |
| 4,519,612 | A * | 5/1985 | Tsao | 473/248 |
| 4,655,459 | A * | 4/1987 | Antonious | 473/338 |
| 5,228,689 | A * | 7/1993 | Donofrio, Sr. | 473/245 |
| 5,421,098 | A * | 6/1995 | Muldoon | 33/508 |
| 5,429,356 | A * | 7/1995 | Dingle et al. | 473/251 |
| 5,533,730 | A * | 7/1996 | Ruvang | 473/251 |
| 5,722,177 | A * | 3/1998 | Reilly, III | 33/508 |
| 5,782,005 | A * | 7/1998 | Reilly, III | 33/508 |
| 5,924,938 | A * | 7/1999 | Hines | 473/307 |
| 6,430,829 | B1 * | 8/2002 | Williamson et al. | 33/508 |
| 6,449,860 | B1 * | 9/2002 | Nakai | 33/508 |
| 6,754,970 | B2 * | 6/2004 | Daniels | 33/508 |
| 6,799,377 | B2 * | 10/2004 | Sones | 33/508 |

* cited by examiner

*Primary Examiner*—Sebastiano Passaniti
(74) *Attorney, Agent, or Firm*—Stanley M. Miller

(57) ABSTRACT

A tool has an adjustable lie angle, face angle, weight, and shaft length and is used by a golfer to adjust a putter to the optimal lie angle, face angle, weight and shaft length for that golfer. The tool head has a face plate and a sole disposed normal to one another. An angle member has a vertical wall disposed parallel to the face plate and a horizontal wall that overlies the sole. A hosel is pivotally mounted to the vertical wall and a first protractor is fixedly secured to the vertical wall. A marker on the hosel indicates the lie angle on the first protractor. A second protractor secured to the sole indicates a face angle when the shaft of the club is rotated about its axis. Weights are selectively added to the toe, heel, or mid-point of the putter head to determine an optimal weight and weight distribution.

7 Claims, 4 Drawing Sheets

TOOL FOR DETERMINING OPTIMAL PUTTER CHARACTERISTICS

BACKGROUND OF THE INVENTION

1. Field of the Invention

This invention relates, generally, to a tool that provides information to a golfer or a golf professional working with the golfer as to how to modify a putter so that it has a length, lie angle, face angle, and weight that meets the personal requirements of the golfer.

2. Description of the Prior Art

The lie angle of a putter is the angle between the putter shaft and the ground. For example, if a shaft is disposed at a right angle to the putter head, the lie angle is ninety degrees (90°). When a putter is held properly, the sole of the putter should be parallel to the ground.

Many golfers, however, hold their putters with the sole of the putter head in oblique relation to a ground surface. If the toe of the putter head is elevated above the heel, the golfer has two choices: 1) learn to hold the putter so that the sole is parallel to the ground or 2) modify the putter by increasing its lie angle so that the sole is parallel to the ground even when the golfer does not change his or her putting style.

The same observation applies if a golfer putts with the heel of the putter elevated relative to the toe. The golfer can improve his or her stance, or the putter can be adjusted by decreasing its lie angle so that the sole will be parallel to the ground even when the golfer uses an unmodified stance.

Recognizing that golfers have varying styles of grips and stances when putting, manufacturers provide putters having many different lie angles. A golfer therefore must try out numerous putters in an attempt to find one that has a lie angle that is optimal for his or her style of putting. Still, with the help of a golf professional or by trial and error, many golfers will learn that either the heel or the toe of the putter is elevated when they perform a putt. The lie angle of the putter can then be increased or decreased to accommodate the golfer's style.

The face angle of a putter head is the angle between the striking surface of the putter head and an intended line of ball travel. When a putt is made with perfection, the angle between the striking surface and the intended line of ball travel will be exactly ninety degrees (90°). However, many golfers consistently hit a putt with their putter in a "closed" position, i.e., so that the angle is eighty-nine degrees (89°), eighty-eight degrees (88°) and so on. If the angle is less than ninety degrees (90°), a right-handed golfer will putt the ball to the left of the target hole. If the striking surface is held in an "open" position at time of impact, the angle is ninety-one degrees (91°), ninety-two degrees (92°), and so on. A right-handed golfer putting with an open putter at time of impact will putt the ball to the right of the target hole.

The opposite results are experienced by left-handed golfers.

Putters are manufactured having ninety degree (90°) face angles. Accordingly, a golfer who consistently putts with a closed or open putter at point of impact has two options. First, learn to putt squarely, where the putter in no longer closed or open, or adjust the face angle of the putter head to compensate for the golfer's habit. Where the second option is selected, the golfer himself or a golf professional working with the golfer must carefully measure the degrees of closing or opening and adjust the putter head accordingly.

Another factor that affects putting is the weight of the putter head. If a putter head is too heavy for a particular golfer, the putts will consistently fall short because the golfer exerts too little force. Conversely, a putter head that is too light will result in putts that overshoot the target hole because the golfer is exerting too much force.

Manufacturers therefore make putter heads of differing weights. However, even when a putter is found that is substantially perfect, many golfers will still strike the ball too hard or too soft because the putter weight will not be ideal for them. Again, the golfer has two options—learn to putt with the given weight, or adjust the weight by trial and error or have a golf professional adjust the weight of the putter to compensate for the putting style of the golfer.

The fourth and final major variable is the length of the club shaft. After observing a golfer using a shaft of a certain length, a golf professional may change the golfer's putting style so that the style is in concordance with the length of the shaft, or the professional may decide to change the length of the shaft so that the golfer may keep the style to which he or she has become accustomed.

It is not a simple matter, however, for a golf professional to adjust the lie angle of a putter precisely to the lie angle that a particular golfer requires. Nor is it easy to adjust the face angle to the precise face angle required by a particular golfer. Moreover, the exact weight required is not easily quantifiable. Adjusting the length of a putter shaft also requires a precise measurement if the ideal length is to be found.

There is a need, therefore, for a tool that enables a golfer or a golf professional working with the golfer to determine how much and in what direction the lie angle, face angle, weight, and length of a putter should be adjusted to compensate for the putting style of the golfer.

No such tool was heretofore known. Nor was it obvious to those of ordinary skill in the art, in view of the prior art considered as a whole at the time the present invention was made, how such a tool could be provided.

SUMMARY OF THE INVENTION

The long-standing but heretofore unfulfilled need for a tool that enables a golfer to determine the amount and direction of adjustment to make to a putter so that the putter, as adjusted, has a lie angle, face angle, putter head weight and shaft length that is ideal for that golfer is now met by a new, useful, and non-obvious invention.

The novel tool has a structure much like that of a putter, but it has pivotal and adjustable parts so that its lie angle, face angle, weight and shaft length may be adjusted. Equally important, measurement devices such as protractors are included so that the lie angle and face angle may be measured with precision. Moreover, weight members may be added in any combination to the toe, the heel, and the middle of the putter head and the length of the putter shaft may be changed.

The novel tool includes an elongate, replaceable shaft, a grip formed on a proximal end of the shaft, a hosel formed on a distal end of the shaft, and a putter head having a club face formed integrally with a sole. The club face is disposed substantially normal to the sole.

An angle member is mounted to the putter head. The angle member has a flat vertical wall and a flat bottom wall formed integrally with one another. The flat vertical wall is disposed substantially perpendicular to the club face and is laterally spaced apart from the club face, behind it so as not to interfere with the ball-striking surface. The flat bottom wall of the angle member overlies and abuts the sole.

An aperture is formed in the flat vertical wall of the angle member, mid-length thereof, and a laterally-extending unthreaded bore is formed in a distal end of the hosel.

A first protractor or protractor segment is positioned in abutting relation to a leading side of the flat vertical wall of the angle member. Accordingly, it is positioned between the vertical wall of the angle member and the striking surface of the club face. The first protractor segment has a flat bottom edge, an arcuate top edge, and an aperture formed therein near the flat bottom edge, mid-length thereof. The flat bottom edge is disposed in parallel, vertically spaced relation to the sole.

A straight pivot pin extends successively through the aperture formed in the first protractor, the aperture formed in the flat vertical wall, and through the hosel bore so that the elongate shaft is pivotable about the straight pivot pin.

The first protractor segment is tightly secured to the flat vertical wall of the angle member and therefore it does not rotate relative to the flat vertical wall.

The elongate shaft pivots freely about the straight pivot pin.

A first marker in the form of a straight line is imprinted on a leading side of the hosel. The first protractor segment provides an analog dial and the first marker provides a first indicator.

To determine an optimal lie angle for a golfer, the golfer holds the tool in his or her customary putting stance on a level surface, takes some sample putts and either the golfer or a golf professional adjusts the sole until the sole is parallel to a level playing surface, and the golfer or golf professional reads the lie angle of the elongate shaft by noting the position of the marker relative to the first protractor segment. The putter used by the golfer during normal play is then adjusted to have the lie angle indicated by the first protractor segment.

A bottom wall aperture is formed in the flat bottom wall of the angle member, mid-length thereof, and a sole aperture is formed in the sole, mid-length thereof so that the bottom wall aperture and the sole aperture are in alignment with one another.

A screw extends through the aligned apertures of the bottom wall and the sole. A nut is disposed in screw-threaded engagement with a free end of the screw so that the elongate shaft is rotatable about its longitudinal axis of symmetry and so that the screw defines the axis of rotation.

The putting stroke of golfers varies widely. Most amateur golfers are unable to consistently putt so that the face of the putter is at a perfect ninety degrees (90°) to the line of intended path of the ball at impact. There are a number of causes of this imperfection in a putting style of many golfers.

First, many golfers hold their hands in leading relation to a golf ball during putting and many hold their hands in trailing relation to the golf ball. The leading position decreases the loft of the putter and the trailing position increases the loft. Second, many golfers have a tendency to strike the ball slightly before it reaches the exact point at which the face angle is ninety degrees (90°), i.e., they hit the ball with an open face. Other golfers consistently have a tendency to strike the ball slightly after the face angle reaches ninety degrees (90°), i.e., they hit the ball with a closed face. Such change in loft or face angle can be compensated for by changing the face angle of the putter. Changing the face angle in a direction so that the toe of the putter trails the heel thereof is known as opening the putter and changing the face angle in a direction so that the toe of the putter leads the heel thereof is known as closing the putter.

To determine the degree of opening or closing that is needed in a putter to compensate for the imperfect putting stroke of the golfer, a second protractor segment, serving as a second analog dial, is secured against movement to an upper surface of the sole and a second marker in the form of a straight line is imprinted upon the upper surface of the sole in parallel relation to the club face. A second indicator has a first end secured in overlying relation to the flat bottom wall of the angle member and a second end that extends over the second protractor segment. The second indicator is in registration with the second marker when the flat vertical wall of the angle member is parallel to the club face.

A golf professional observes a golfer making putts with the novel tool to determine whether the golfer is hitting the ball with an open face, i.e., pushing the ball, or hitting the ball with a closed face, i.e., pulling the ball. A golfer can by trial and error attempt to do this on his or her own without the help of a golf professional. If the golfer's putts consistently go straight, no adjustment to the face angle is needed. If the golfer pushes or pulls the putts consistently, the club face is then rotated to either open or close the club face angle, respectively, by an amount required to compensate for fault in the putting swing.

The position of the second indicator relative to the second protractor segment is read and recorded. The face angle of the putter normally used by the golfer during play is then angularly adjusted by the angle and direction indicated by the second protractor.

To enable a golfer to determine the optimal weight for a putter, a plurality of internally threaded blind bores is formed in the sole of the novel tool near the trailing edge thereof. A first blind bore of the plurality of blind bores is formed near the toe end of the sole, a second blind bore of said plurality of blind bores is formed mid-length of the sole, and a third blind bore of the plurality of blind bores is formed near the heel end of the sole.

Each blind bore may be replaced by an internally threaded throughbore but blind bores are preferred so that the bottom of the sole is not apertured by each throughbore.

A first, second, and third screw, respectively, screw-threadedly engage said first, second, and third blind bores from the top side of the sole.

Centrally apertured weight members are selectively ensleeved onto the respective first, second, and third screws and are respectively secured thereto by nuts, preferably wing nuts, so that the weight members can be added and removed from each of the screws in varying combinations until the desired amount of weight and the desired weight distribution is found.

The length of the shaft of the novel tool is changed by removing the existing shaft and replacing it with shafts of other lengths using conventional methods.

An important advantage of the novel tool is that a golfer may determine the optimal lie angle, face angle, weight, and length of a putter that is optimal for that golfer.

A closely related advantage is that the novel tool enables a golfer to quantify the changes to be made to a conventional putter to create the optimal lie angle, face angle, weight, and length of the putter for its owner.

A more general advantage is that a golfer using a putter having the ideal lie angle, face angle, weight, and length for him or her will be able to lower his or her score.

These and other advantages will become apparent as this disclosure continues. The invention accordingly comprises the features of constructions, arrangement of parts, and combination of elements indicated in the following detailed description, and the scope of the invention is set forth in the claims.

DETAILED DESCRIPTION OF THE PREFERRED EMBODIMENT

Figure 1:
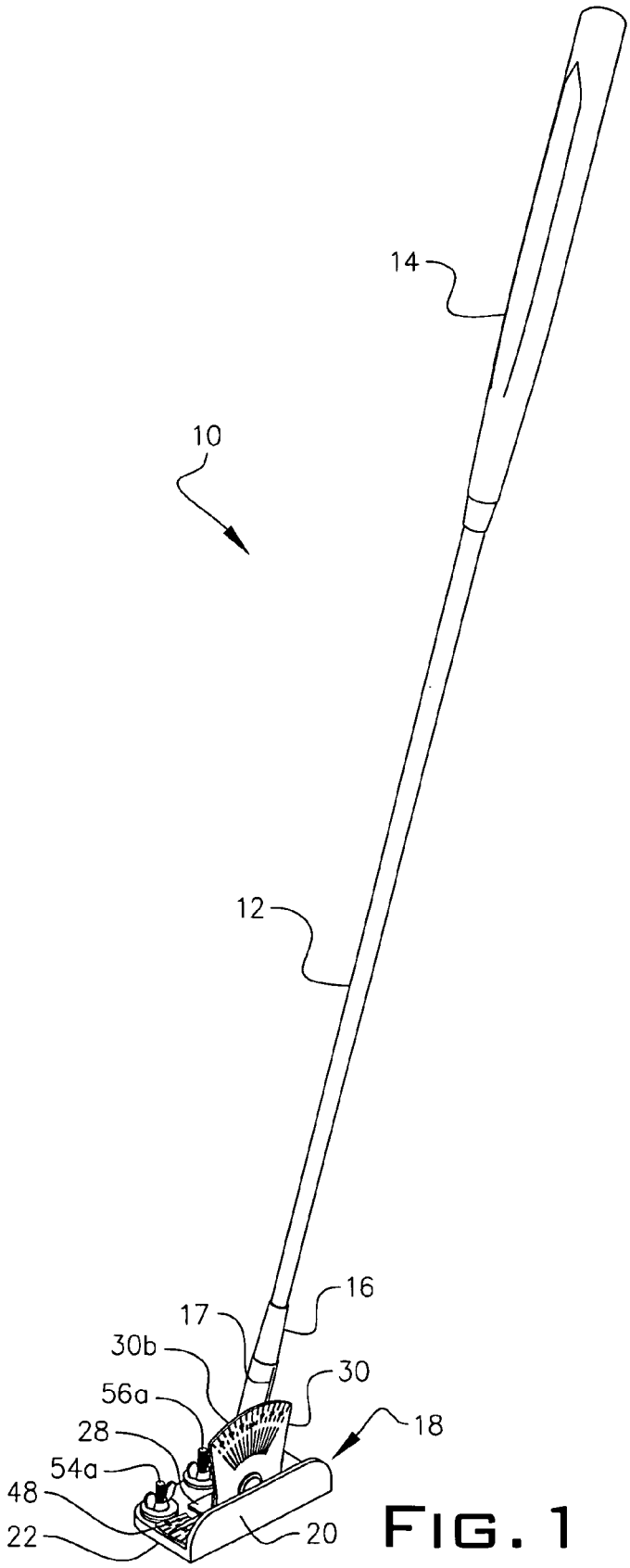
FIG. 1 is a perspective view of the novel tool.

Referring now to FIG. 1, it will there be seen that an illustrative embodiment of the invention is denoted as a whole by the reference numeral 10.

Novel tool 10 includes shaft 12, grip 14 at a proximal end of shaft 12, hosel 16 at a distal end of said shaft, and a putter head 18 having an "L"-shape when viewed in front or rear elevation.

Flat wall or club face 20 is formed integrally with bottom wall or sole 22 and is disposed normal thereto. When tool 10 is held in a conventional manner so that it may be used in accordance with the teachings and suggestions of this disclosure, club face 20 is positioned in a substantially vertical plane. The angle by which club face 20 is tilted from a perfectly vertical plane is the loft of the club. Putters are made with a loft of 2–6 degrees (2–6°).

Figure 3:
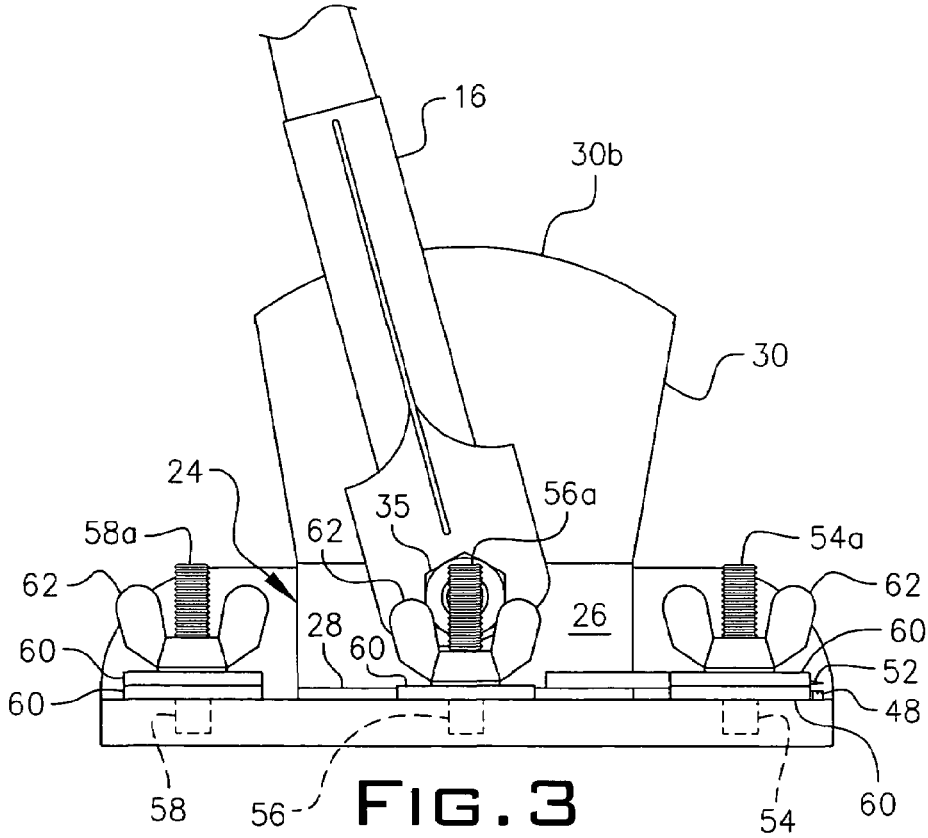
FIG. 3 is a rear elevational view thereof.

As perhaps best understood in connection with FIG. 3, angle member 24 includes a flat vertical wall 26 and a flat bottom wall 28 formed integrally therewith in normal relation thereto. Flat vertical wall 26 is laterally spaced apart from club face 20 and flat bottom wall 28 overlies and abuts sole 22. Flat vertical wall 26 and flat bottom wall 28 have a common extent.

Figure 4:
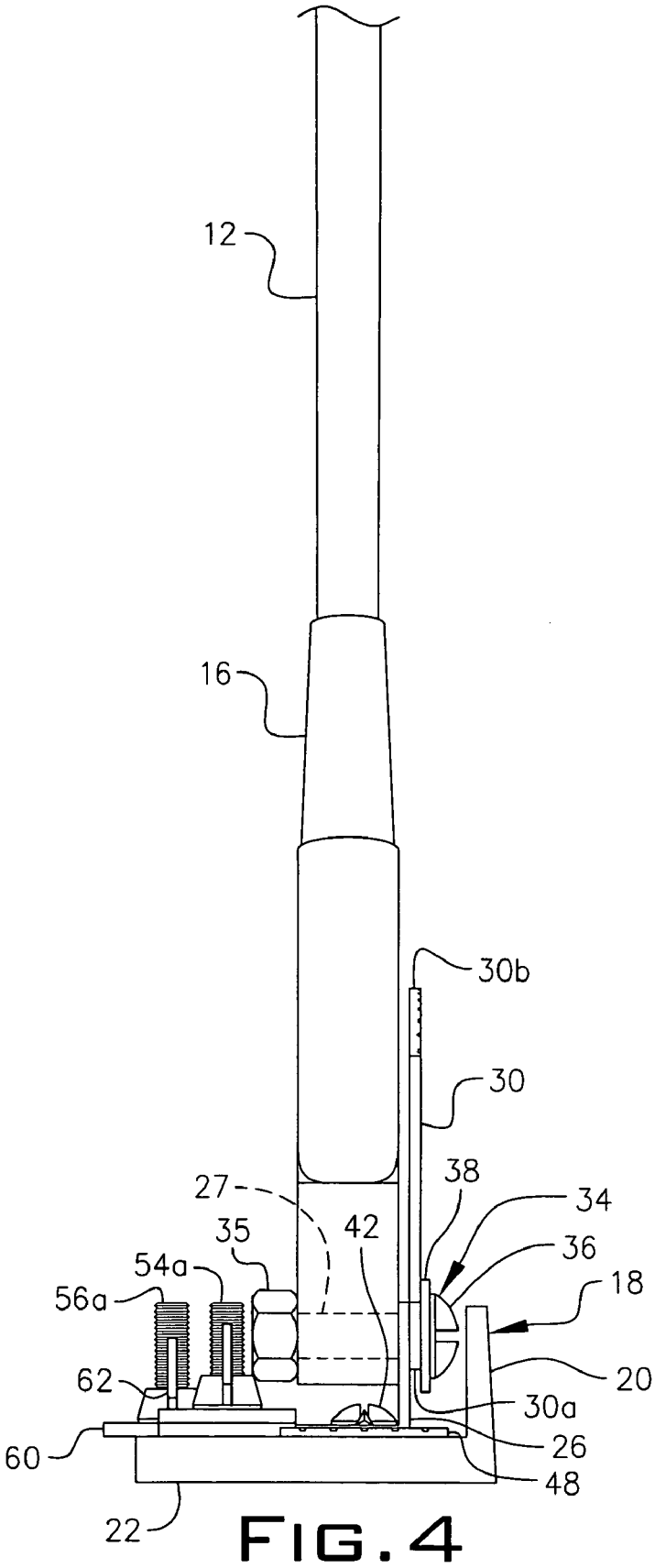
FIG. 4 is an end view thereof.

As indicated in FIG. 4, an unnumbered aperture is formed in flat vertical wall 26 mid-length thereof and a laterally-extending unthreaded bore 27 is formed in the distal end of hosel 16.

Figure 2:
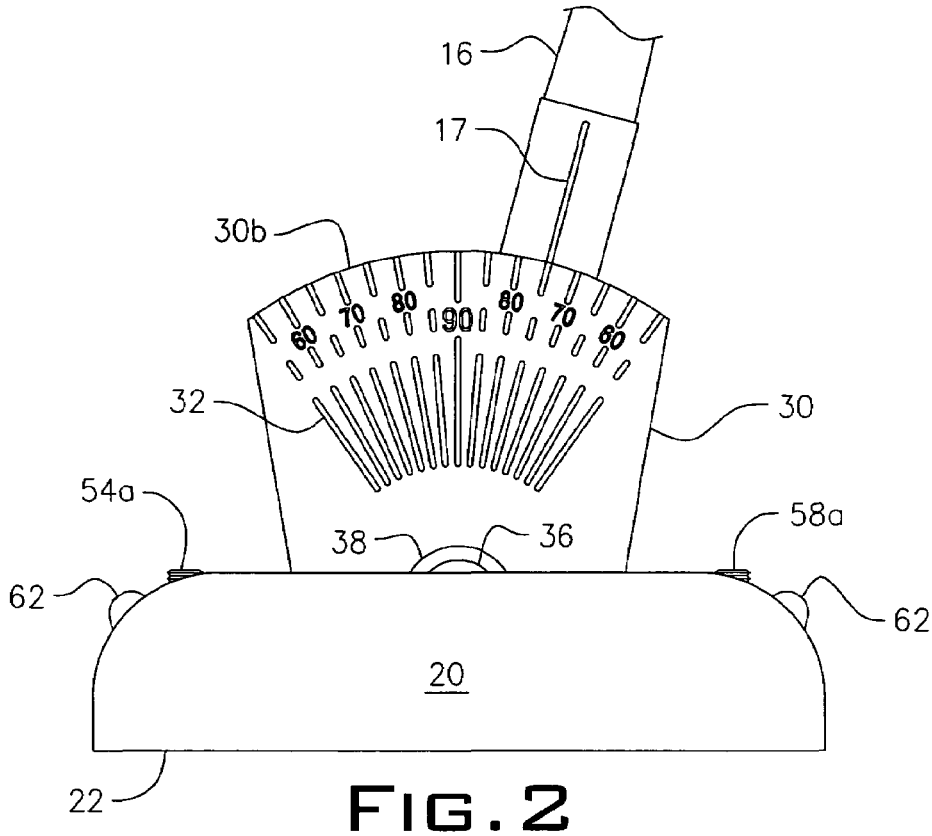
FIG. 2 is a front elevational view thereof.

A transparent or translucent first protractor segment 30 has a flat bottom edge 30*a* that is spaced vertically from sole 22 as depicted in FIG. 4 and an arcuate top edge 30*b* as best understood in connection with FIGS. 1–3. A plurality of straight radial lines, representing angles and collectively denoted 32 in FIG. 2, are imprinted on first protractor segment 30. An aperture is formed in first protractor segment 30 near flat bottom edge 30*a*, mid-length thereof and said aperture is in axial alignment with bore 27. First protractor segment 30 is positioned in abutting relation to a leading side of flat vertical wall 26 of angle member 24.

As used herein, the term "leading side" of any part refers to the side of said part that is nearest club face 20 of putter head 18.

A screw 34 that serves as a pivot pin extends successively through the aperture formed in first protractor segment 30, the aperture formed in flat vertical wall 26, and through hosel bore 27 so that shaft 12 is pivotable about said screw. Nut 35 maintains screw 34 in its operable position. In a prototype of the invention, for example, screw 34 has a tool-engageable head 36. A washer 38 is disposed between head 36 and the leading side of flat vertical wall 26. The length of screw 34 is greater then the width of hosel 16, and nut 35 engages the trailing end of the screw that extends from the bore formed in said hosel. When nut 35 is tight, it and screw 34 do not rotate. First protractor segment 30 is tightly secured to flat vertical wall 26 and therefore said segment, like said screw and nut, does not rotate relative to flat vertical wall 26. Shaft 12 pivots freely about screw 34 because hosel bore 27 is unthreaded as aforesaid.

A first marker in the form of straight line 17 (FIG. 2) is imprinted on the leading side of hosel 16. First protractor segment 30 is an analog dial and first marker 17 is the indicator. When shaft 12 is positioned at a ninety degree (90°) angle relative to the ground, indicator 17 aligns with the ninety degree (90°) line imprinted on first protractor segment 30. As drawn in FIG. 2, the lie angle is seventy five degrees (75°).

A full protractor could be used instead of protractor segment 30, but most of the protractor is not needed so use of the segment is preferred. In the claims that follow, the term "protractor" should be understood to include a full protractor and a partial protractor or protractor segment as depicted in the drawings.

To determine the optimal lie angle for a golfer, the golfer holds tool 10 in his or her customary putting stance on a level surface, tries a couple of putts using his or her normal swing, and a golf professional adjusts sole 22 until said sole is parallel to the level surface. The golf professional then reads the angle of shaft 12 by noting the position of first indicator 17 relative to first protractor segment 30. This procedure is followed for a right-handed or a left-handed golfer. That lie angle is then recorded so that a putter or putters normally used by the golfer may be modified so that its lie angle is equal to the measured optimal lie angle. A golfer may try, by trial and error, to find the optimal lie angle without the aid of a professional.

Loft is sometimes defined as the angle of the club face relative to the shaft position. When viewing a club head from an end position, the top of a lofted club face is closer to the shaft than the bottom of the club face. As the loft increases, the top of the club face is closer to the shaft and the bottom of the club face is further from the shaft. The degree of loft is more pronounced in the irons than in putters.

The face angle of a putter is defined as the angle between the club face and the intended path of the ball. Thus, a square club face angle is achieved when the club face is exactly perpendicular to the intended path. For a right-handed golfer, as mentioned above, an open face angle means that the toe of the club is further from the target than is the heel. A closed face angle means that the heel of the club is further from the target then the toe. For a right-handed golfer, an open face angle results in a miss of the target hole to the right, i.e., a push, and a closed face angle results in a miss of the target hole to the left, i.e., a pull.

The loft and the face angle are interrelated and both are affected by the way that a golfer holds and swings a club.

A golfer who putts with his or her hands in leading relation to the ball reduces the loft and a golfer who putts with his or her hands in trailing relation to the ball increases the loft. A golfer who strikes the ball with the face of the club either open or closed will not start the ball straight at the target relative to the intended path of the ball. A proper adjustment to the face angle of the club compensates for such imperfections in a golfer's stance or swing. The following structure is provided to enable a golfer to determine the degree of opening or closing that is needed in a putter to compensate for such leading/loft decreasing or trailing/loft increasing handling of the putter.

Figure 6:
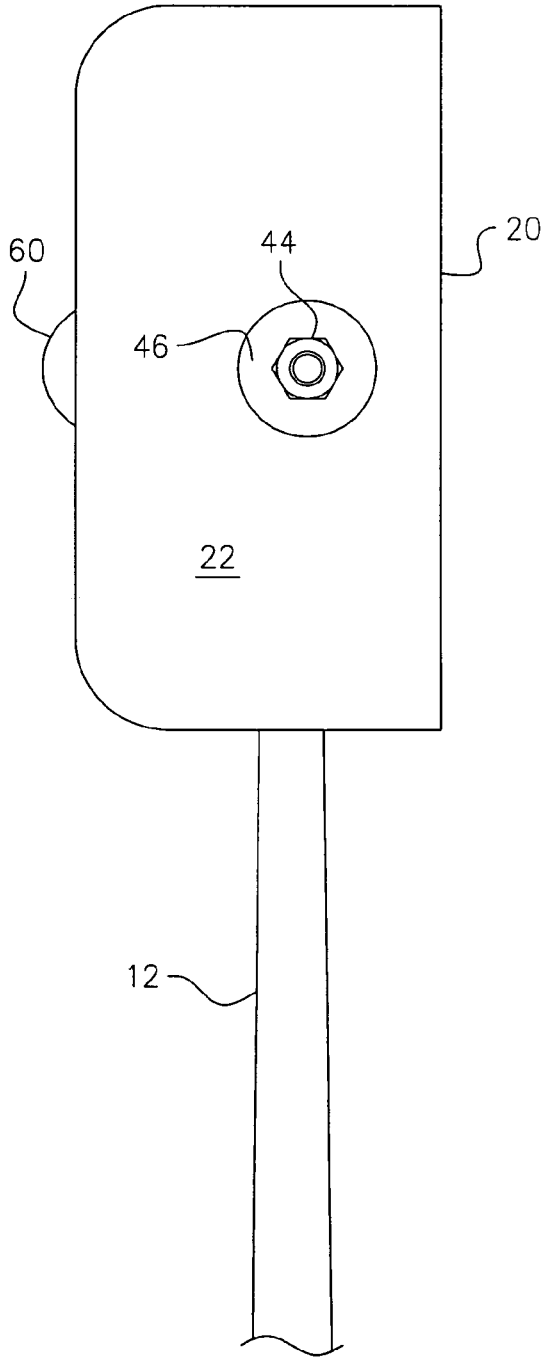
FIG. 6 is a bottom view thereof.

An aperture is formed in flat bottom wall 28 of angle member 24, mid-length thereof, and in sole 22, mid-length thereof so that said apertures are in alignment with one another. Screw 42 having a tool-engageable head extends through said aligned apertures and nut 44 engages the free end of said screw as depicted in FIG. 6. The free end of the screw is substantially flush or slightly recessed with respect to the bottom surface of sole 22. Said bottom surface is countersunk as at 46 to facilitate tool-engagement of said nut and so that the nut is substantially flush or slightly recessed with respect to said bottom surface.

Shaft 12 is therefore rotatable about its longitudinal axis of symmetry. Screw 42 defines the axis of rotation.

Figure 5:
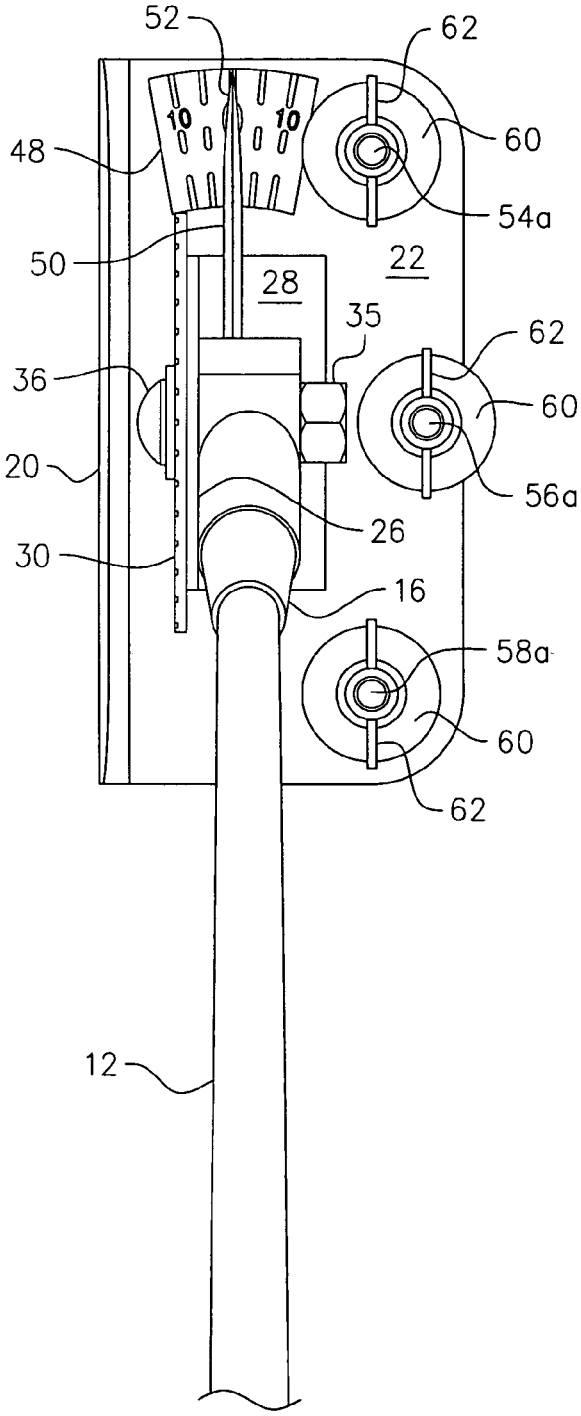
FIG. 5 is a top view thereof.

A second protractor segment 48, best depicted in FIG. 5, is secured against movement by any suitable means, including a transparent adhesive, to an upper surface of sole 22 at the end of the sole that is the toe end for a right-handed golfer or the heel end for a left-handed golfer. A second marker in the form of straight line 50 is imprinted upon the upper surface of sole 22 in parallel relation to club face 20. An indicator or pointer 52 has a first end secured by suitable means in overlying relation to flat bottom wall 28 of angle member 24 and a second means that extends over second protractor segment 48, thereby serving as a second indicator. Pointer 52 is in registration with marker 50 when flat vertical wall 26 of angle member 28 is parallel to club face 20 of putter head 10.

A golf professional observes the golfer making putts using novel tool 10 to determine whether the golfer is pushing or pulling putts on a consistent basis. If such is the case, club face 20 is then rotated to close or open the club face angle, respectively, by an amount required to compensate for such imperfection in the golfer's swing. The position of second indicator 52 relative to second analog dial 48 and its direction relative to straight line 50 is read and recorded so that a putter or putters used by the golfer during play may be adjusted by the recorded amount in the correct direction. A golfer may change the club face angle by trial and error without the help of a professional.

The weight of a club head is yet another factor that requires adjusting to the personal requirements of a golfer. The following structure enables the novel tool weight to be varied from sixteen (16) ounces to twenty-one (21) ounces. A golfer can therefore quickly determine which weight best suits his or her requirements and the weights of the putter or putters used by the golfer during play may be adjusted accordingly.

Three blind bores 54, 56, and 58 (FIG. 3) are formed in sole 22 near the trailing edge thereof. First blind bore 54 is formed near the toe end, second blind bore 56 is formed mid-length thereof, and third blind bore 58 is formed near the heel end. A threaded stem 54*a*, 56*a*, 58*a* is screw-threadedly engaged with its associated blind bore. Centrally apertured one (1) gram weights, collectively denoted 60, are then ensleeved onto their respective threaded stems and secured thereto by nuts, preferably wing nuts 62, so that weights 60 can be added and removed from each of the threaded stems in varying combinations until the desired amount of weight and the desired weight distribution is found. Some golfers may want to put all or most of the weight at the toe end, some may want all or most of the weight at the heel end, and some may want a perfectly balanced weight distribution or some other pattern of distribution. Once the total desired weight and its desired distribution have been found, the weight and weight distribution of the golfer's putter or putters may be adjusted as required to match the optimal weight and weight distribution as determined by novel tool 10.

Similarly, shaft 12 may be replaced by conventional means until the shaft length ideal for the golfer is found and the shaft of the putter or putters used during play are changed to the optimal length for that golfer.

The novel system thus provides an easy, effective way for a golfer to custom design a putter that is suited to his or her particular requirements. The lie angle, face angle, weight, weight distribution, and shaft length of the optimal putter are determined by the novel tool, making it possible for a golfer to modify his or her existing putters or to order a custom-built putter that will enable the golfer to reduce his or her score. The novel system is built of readily available parts and is easy and economical to manufacture.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A tool having an adjustable lie angle, face angle, weight, and shaft length comprising:

an elongate shaft;

a grip formed on a proximal end of said shaft;

a hosel formed on a distal end of said shaft;

a putter head having a club face formed integrally with a sole;

said club face being disposed substantially normal to said sole;

an angle member having a flat vertical wall and a flat bottom wall formed integrally therewith in normal relation thereto;

said flat vertical wall being laterally spaced apart from said club face;

said flat bottom wall overlying and abutting said sole;

an aperture formed in said flat vertical wall mid-length thereof;

a laterally-extending bore formed in a distal end of said hosel;

a first protractor having a flat bottom edge and an arcuate top edge;

an aperture formed in said first protractor near said flat bottom edge thereof, mid-length of said first protractor;

said first protractor positioned in abutting relation to said flat vertical wall of said angle member;

said flat bottom edge disposed in parallel, vertically spaced relation to said sole;

a straight pivot pin extending successively through the aperture formed in said first protractor, the aperture formed in said flat vertical wall, and through said hosel bore so that said elongate shaft is pivotable about said straight pivot pin;

whereby said first protractor is tightly secured to said flat vertical wall and therefore said first protractor does not rotate relative to said flat vertical wall;

whereby said elongate shaft pivots freely about said straight pivot pin.

2. The tool of claim 1, further comprising:

a first marker in the form of a straight line imprinted on a leading side of said hosel;

said first protractor providing a first analog dial and said first marker providing a first indicator;

whereby to determine an optimal lie angle for a golfer, the golfer holds the tool in his or her customary putting stance on a level surface, the sole is adjusted until said sole is parallel to the level surface, and lie angle of the elongate shaft is read by noting the position of said first indicator relative to said first protractor.

3. The tool of claim 2, further comprising:

a bottom wall aperture formed in said flat bottom wall of said angle member, mid-length thereof;

a sole aperture formed in said sole, mid-length thereof so that said bottom wall aperture and said sole apertures are in alignment with one another;

a screw extending through said aligned bottom wall and sole apertures;

a nut disposed in screw-threaded engagement with a free end of said screw;

whereby said elongate shaft is rotatable about its longitudinal axis of symmetry; and whereby said screw defines the axis of rotation.

4. The tool of claim 3, further comprising:

a second protractor secured against movement to an upper surface of said sole, said second protractor providing a second analog dial;

a second marker in the form of a straight line imprinted upon the upper surface of said sole in parallel relation to said club face;

a second indicator having a first end secured in overlying relation to said flat bottom wall of said angle member and a second end that extends over said second protractor;

said second indicator being in registration with said second marker when said flat vertical wall of said angle member is parallel to said club face;

whereby a golf professional observes a golfer making putts to determine whether the golfer is striking the ball with the club face in a push or pull position at the moment of ball impact;

whereby the position of said second indicator relative to said second analog dial is read and recorded so that the degree of opening or closing that is needed in a putter to compensate for the golfer's putting technique is determined; and whereby said club face is rotated to close or open the club face angle, respectively, by an amount required to compensate for the golfer's putting technique so that the ball is struck with the face angle square to an intended path of travel.

5. The tool of claim 1, further comprising:

a plurality of blind bores formed in said sole near the trailing edge thereof;

a first blind bore of said plurality of blind bores formed near the toe end of said sole;

a second blind bore of said plurality of blind bores formed mid-length of said sole;

a third blind bore of said plurality of blind bores formed near the heel end of said sole;

a first threaded stem in screw-threaded engagement with said first blind bore;

a second threaded stem in screw-threaded engagement with said second blind bore;

a third threaded stem in screw-threaded engagement with said third blind bore;

a plurality of centrally apertured weight member being selectively ensleeved onto respective threaded stems of said first, second, and third threaded stems and respectively secured thereto by nuts so that said weight members can be added and removed from each of the threaded stems in varying combinations until the desired amount of weight and the desired weight distribution is found.

6. The tool of claim 5, further comprising:

said nuts being wing nuts to facilitate addition and removal of said weight members.

7. The tool of claim 1, further comprising:

said shaft being detachably secured to said hosel so that shafts of differing lengths may be secured to said hosel.

* * * * *